US007216589B2

(12) United States Patent
Bishop et al.

(10) Patent No.: US 7,216,589 B2
(45) Date of Patent: May 15, 2007

(54) FUSE FOR PROJECTED ORDNANCE

(75) Inventors: David John Bishop, Summit, NJ (US); Herbert R. Shea, Cormondrèche (CH); Donald P. Weiss, Cresskill, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 120 days.

(21) Appl. No.: 10/766,449

(22) Filed: Jan. 27, 2004

(65) Prior Publication Data

US 2005/0183605 A1 Aug. 25, 2005

(51) Int. Cl.
*F42C 19/00* (2006.01)

(52) U.S. Cl. ..... 102/201

(58) Field of Classification Search ..... 102/201
See application file for complete search history.

(56) References Cited

U.S. PATENT DOCUMENTS

| | | | | |
|---|---|---|---|---|
| 3,812,783 | A * | 5/1974 | Yang et al. | 102/201 |
| 4,694,752 | A * | 9/1987 | Titus | 102/215 |
| 5,052,300 | A | 10/1991 | Josse | 102/201 |
| 5,204,490 | A * | 4/1993 | Soltz et al. | 102/201 |
| 5,229,542 | A | 7/1993 | Bryan et al. | 102/491 |
| 6,167,809 | B1 | 1/2001 | Robinson et al. | |
| 6,321,654 | B1 | 11/2001 | Robinson | 102/251 |

FOREIGN PATENT DOCUMENTS

| | | |
|---|---|---|
| EP | 0 807 841 A2 | 11/1997 |
| FR | 2 760 266 | 9/1998 |

OTHER PUBLICATIONS

"Monolithic MEMS optical switch with amplified out-of-plane angular motion", written by "Lopez, D.; Simon, M.E.; Pardo, F.; Aksyuk, V.; Klemens, F.; Cirelli, R.; Neilson, D.T.; Shea, H.; Sorsch, T.; Ferry, E.; Nalamasu, O.; Gammel, P.L", published in "Optical MEMs, 2002. Conference Digest. 2002 IEEE/LEOS International Conference on Aug. 20-23, 2002, pp. 165-166" on "Aug. 23, 2002".

* cited by examiner

*Primary Examiner*—Michael J. Carone
*Assistant Examiner*—Gabriel J. Klein

(57) ABSTRACT

An ordnance fuse apparatus is described that uses electrical and mechanical, and optical devices. The ordnance fuse apparatus includes a controller to control an optical switch and a laser to detonate an explosive charge of the ordnance. Other embodiments include an accelerometer and/or spin detector for detecting that the ordnance has been fired and an optical detector for detecting the proper operation of the laser and a position sensor for detecting correct positioning of the optical switch. Another embodiment includes a microlens to focus the laser optical signal onto the ignitor. In yet other embodiments, the explosive charge is detonated either by ignition of an ignitor or by a shock wave from the ignitor. The resulting ordnance fuse apparatus has significantly reduced size and improved performance and safety.

12 Claims, 2 Drawing Sheets

FUSE FOR PROJECTED ORDNANCE

TECHNICAL FIELD OF THE INVENTION

This invention relates generally to a fusing arrangement for a projected ordnance and, more particularly, to a fusing apparatus implemented using a laser and an optical switch to detonate the ordnance.

BACKGROUND OF THE INVENTION

Fuse systems serve to detonate the main charge ('secondary' of military ordnance) of a munition, a cartridge, or an ordnance (collectively referred to herein as ordnance) at the desired time or location. The fuse (or fuze) plays an essential safety role of preventing accidental detonation of the ordnance, making the ordnance safe to handle. There are a variety of technologies used in fuse systems. The fuses considered here are "programmable": immediately prior to the ordnance being fired from a gun, timing or similar data is loaded into the fuse so that the fuse initiates detonation of the secondary charge of the ordnance at the desired time and/or location. One common approach to such a fuse system is to charge a capacitor, and then discharge it at the desired time across a thin wire to create sufficient local heating or a spark to ignite the primary explosive. On-board electronics or mechanical devices control the discharge timing. Fuses typically incorporate "g-switches" that prevent detonation until the fuse has been exposed to accelerations of a magnitude and time typically only encountered in a gun barrel. There are on-going efforts at fabricating Micro-Electrical Mechanical Switch (MEMS)-based g-switches.

Notwithstanding the advances made by these prior fuse systems, there is a continuing need to significantly reduce the size, improve the performance and safety of the overall ordnance fuse system.

SUMMARY OF THE INVENTION

In accordance with the present invention, an ordnance fuse apparatus is described that uses electrical, mechanical, and optical devices. The ordnance fuse apparatus includes a controller to control an optical switch and a laser to detonate (directly or indirectly) an explosive charge of the ordnance. The resulting ordnance fuse apparatus has significantly reduced size and improved performance and safety.

More generally, we disclose a fuse apparatus for igniting an explosive charge of a fired ordnance, comprising a laser having a controllable optical power level, an optical switch device having a first position for preventing a laser optical signal from impinging on the explosive charge when the fuse apparatus is in a pre-firing state and, in response to an arming signal, establishing a second position for unblocking the laser optical signal to enable it to impinge the explosive charge, a control unit for determining when the ordnance has been fired, for sending the arming signal to the optical switch device, and for increasing the laser power level to a level that detonates the explosive charge.

Other embodiments include an accelerometer and/or spin detector for detecting that the ordnance has been fired and an optical detector for detecting the proper operation of the laser. In yet other embodiments the explosive charge is detonated either by ignition (burning) of an ignitor or by a shock wave from the ignitor, where the ignitor is a small (primary) explosive or pyrotechnic charge that is part of the fuze. Another embodiment includes a microlens to focus the laser optical signal onto the ignitor.

BRIEF DESCRIPTION OF THE DRAWINGS

The present invention will be more fully appreciated by consideration of the following Detailed Description, which should be read in light of the accompanying drawing in which.

In the following description, identical element designations in different figures represent identical elements. Additionally in the element designations, the first digit refers to the figure in which that element is first located (e.g., 100 is first located in FIG. 1).

DETAILED DESCRIPTION

Almost all artillery shells, torpedoes, ordnance incorporate a fuse that serves to detonate the main charge ('secondary') at the desired time. The fuse plays an essential safety role of preventing accidental detonation, making the ordnance safe to handle. The ideal fuse would take up a negligible amount of space, is safe to handle, and ignites the main charge at the correct time. In accordance with the present invention, an ordnance fuse apparatus is disclosed that uses electrical, mechanical, and optical devices for improved safety and reliability of the fuse.

Figure 1:
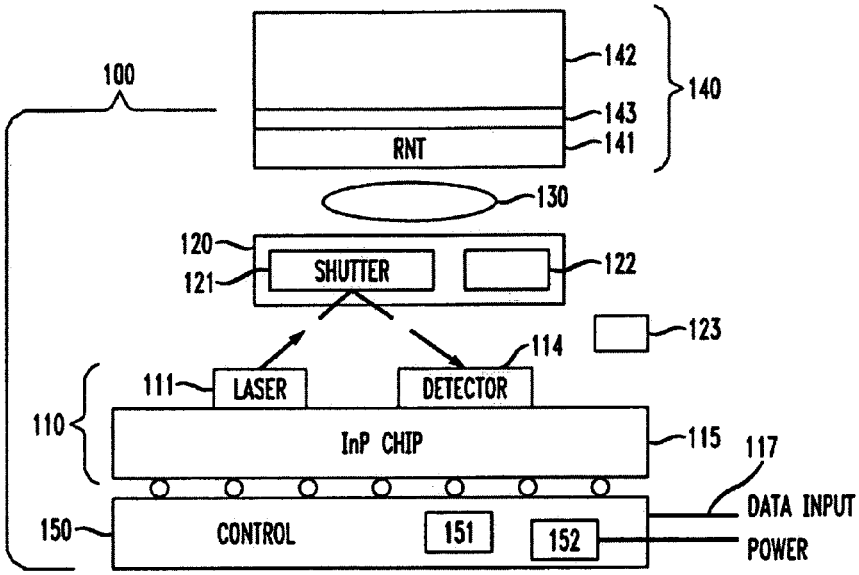
FIG. 1 illustrates, in accordance with the present invention, an ordnance fuse apparatus in its pre-firing state.

With reference to FIG. 1 there is shown, in accordance with the present invention, an illustrative diagram of our ordnance fuse apparatus 100, which together with explosive charge 142 are part of an ordnance to be fired and detonated. The ordnance fuse apparatus 100 is shown to include five main components including a laser and detector unit 110, an optical switch or shutter 120, a microlens 130, an explosive charge 142 and a "programmable" electronic control chip 150. Illustratively, the laser/detector unit 110 includes laser 111 and detector 114 mounted on an Indium phosphide (InP) chip 115, which connects to controller chip 150. The laser/detector unit 110 may include built-in self-test circuitry to test the operation of laser 111 and pre- and post-firing position of optical switch 120.

In one embodiment, the optical switch 120 may be implemented using a MEMS shutter 121 (including an actuator which is used to move the MEMS shutter 121 upon firing of the ordnance.) and an accelerometer (g-switch) 122. The g-switch 122 or a spin detector can be used to detect that the ordnance has been fired. MEMS g-switches are described in U.S. Pat. Nos. 6,167,809 and 6,321,654. The MEMS g-switch 122 signals the controller chip 150 to move the shutter into the firing position.

In a preferred embodiment, the MEMS shutter 121 may be implemented as described in the concurrently filed patent application of D. S. Greywall entitled "MICROMECHANICAL LATCHING SWITCH," Ser. No. 10/766,451, which is incorporated by reference herein. It should be noted that the optical switching performed by MEMS shutter 121 may also occur by tilting a reflective element to redirect laser light to the explosive charge unit 140 rather than by moving the shutter to unblock the light (letting light pass) to explosive charge unit 140. One such tilting MEMS optical switch which may be utilized is a MEMS mirror as described in the article entitled "Monolithic MEMS optical switch with amplified out-of-plane angular motion", written by "Lopez, D.; Simon, M. E.; Pardo, F.; Aksyuk, V.; Klemens, F.; Cirelli, R.; Neilson, D. T.; Shea, H.; Sorsch, T.; Ferry, E.; Nalamasu, O.; Gammel, P. L", published in "Optical MEMs, 2002. Conference Digest. 2002 IEEE/LEOS International Conference on, 20-23 Aug. 2002, Page(s): 165-166" on "2002 Aug. 22".

In this embodiment, electronic control chip 150 would receive a signal from an accelerometer (g-switch) 122 and generate a signal to the MEMS blocking mirror which would redirect the laser light from the detector 114 to the explosive charge unit 140.

In its simplest embodiment, the optical switch 120 need not have an accelerometer 122 incorporated therein. The accelerometer 122 could either not be needed or may be located on a chip separate from the optical switch 120 and/or fuse apparatus 100. Without the accelerometer 122, the electronic control chip 150 uses timing or similar data loaded into the fuse from a fire control unit to determine the desired time and/or location when the fuse is to detonate the ordnance. Using this data, electronic control chip 150 may either initiate a timer or other control programs to control the turning-on/power level of the laser 111 and moving the shutter 121 to initiate detonation of explosive charge unit 140.

However, when fuse apparatus 100 does not include an accelerometer 120 it is less safe, since accelerometer 122 provides a redundant safeguard, providing a positive indication of the ordnance being fired. Redundancy is provided since the mechanical activation of accelerometer 122 would be used to detect the ordnance firing and signal the electronic control chip 150 to increase the power level of the laser 111 to ignite explosive charge unit 140. Note for additional safety, a spin-sensor 123 could be incorporated with the fuse apparatus 100 to detect the spin that occurs when the ordnance is fired and signal the electronic control chip 150. This spin-sensor 123 would provide additional safety that the ordnance would not explode for any g-force, e.g., dropping, not caused by ordnance being fired.

The explosive charge unit 140 may include an explosive charge 142 alone or in combination with a Reactive Nano Technologies (RNT) foil 141 (as a primer charge). The RNT foil 142 is a highly energetic nano-metal material that is easily ignited by a focused laser. It should be noted that other types of pyrotechnic or explosive device that can be ignited by a focused laser could be substituted for the RNT foil 141. When the ordnance includes an explosive charge 142, but not a RNT foil 141, the laser 111 power must be made sufficient to directly ignite the explosive charge 142. When the explosive charge unit 140 includes a RNT foil 141, the laser 111 ignites RNT foil 141, which then ignites the explosive charge 142. When a RNT foil 141 is used, it is implemented as part of the ordnance fuse apparatus 100, while the explosive charge 142 is not included as part of the ordnance fuse apparatus 100.

FIG. 1 shows ordnance fuse apparatus 100 during it pre-fire state. During the pre-fire state and immediately prior to the ordnance being fired from a gun, controller 150 receives timing or similar data, via Data input leads 117. This data is used to program the controller 150 to static test the ordnance fuse apparatus 100 and to control the detonation of the explosive charge 140 of the ordnance at the desired time and/or location. Note that controller 150 may be powered by an included battery 151 that is turned-on by a signal on one of the Data leads or by a capacitor 152 that is charged via one of the Data leads, or by a separate power lead, during the pre-fire state.

Figure 2:
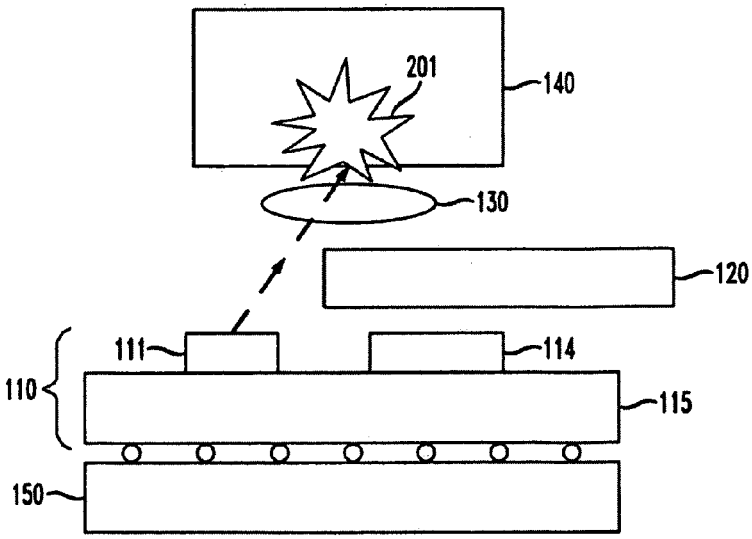
FIG. 2 illustrates the ordnance fuse apparatus in its post-firing and detonation state.
Figure 3:
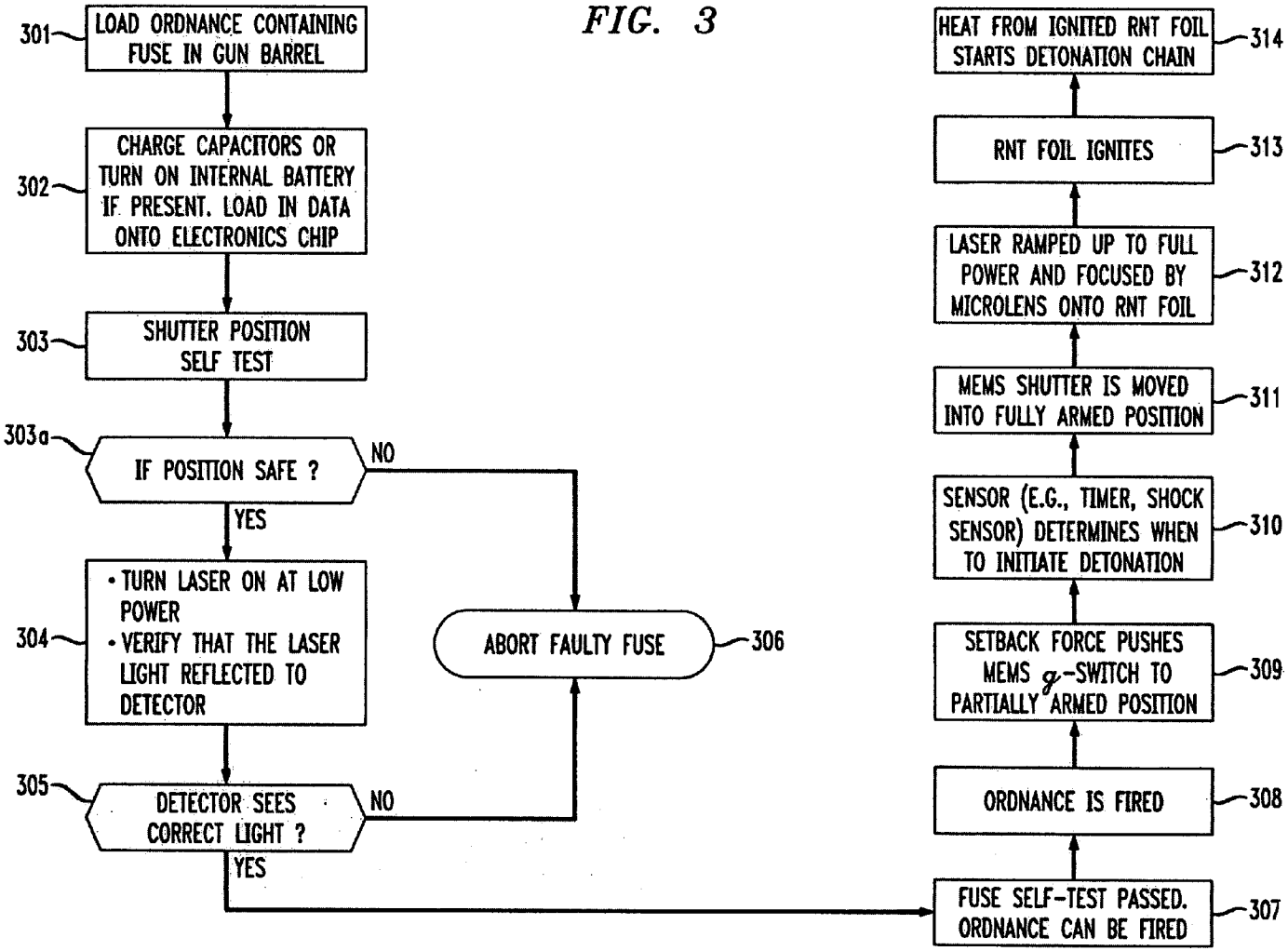
FIG. 3. Describes the sequence of operations of our fuse apparatus.

With joint reference to FIGS. 1-3, we describe the sequence of operations of our ordnance fuse apparatus 100 for use by a gun apparatus. The description assumes that the optical switch 120 is implemented using a MEMS shutter including an accelerometer 122. In step 301 the ordnance (containing our fuse apparatus 100 of FIG. 1) is loaded in the gun barrel and coupled to the Data leads from the gun fire-control unit (not shown). In step 302, the capacitor(s) 152 is charged or the internal battery is "turned-on" to provide power to operate the fuse apparatus 100. Controller 150 then receives fire-control programs and/or data via Data leads 117, in a well-known manner from the fire control unit of the gun.

In step 303, controller 150 performs self-testing to check that the MEMS shutter 120 position is in the closed (blocking) position, preventing laser light from reaching the explosive charge unit 140. The MEMS shutter 121 position may be determined using a mechanical position sensor. If the MEMS shutter position is not correct, the procedure is aborted, in step 306, and an Abort signal is sent back to the fire control unit to prevent the ordnance from being fired. If the position is correct, then in step 304 controller 150 checks the operation of the laser 111 and detector 114, by detecting low-power pulses (<1 mW) from the laser 111 which are reflected by the shutter 120 onto the detector 114. In step 305, if it is determined that the MEMS shutter position is not safe, then in step 306 an Abort signal is sent back to the fire control unit to prevent the ordnance from being fired. Note the low power laser pulses are of such a low power that they cannot ignite the explosive even if the shutter somehow were open.

If the position is safe, the self-test passed and the fire control unit is notified, in step 307, that the ordnance can be fired. This information is transmitted back to the fire control unit during a talkback phase of the pre-firing state, to confirm data decoding and correct ordnance fuse apparatus 100 operation. The steps 301-307 complete the pre-firing state.

In step 308 the ordnance is fired and the rapid ordnance acceleration causes accelerometer (g-switch) 122 to move MEMS shutter 121 to the partially armed position in step 309. In step 310, a separate sensor (e.g., a timer or shock sensor) determines when to initiate detonation. That is, the fuse may be programmed by controller 150 to detonate after a certain time from firing or there may be some other means to determine when the fuse should go off, for example another shock sensor to detect when it has hit a wall or tank, or a proximity sensor or an altimeter, etc. In step 311, the MEMS shutter enters a fully armed state. This may be accomplished by having the MEMS shutter position moved again electrically or thermally in response to a shutter control signal from controller 150. The shutter control signal is applied after a predetermined programmed time has elapsed or in response to the shock sensor signal. The ordnance is then ready to detonate and, in step 312, the laser 111 power is ramped up to its maximum value. In the fully armed state step 313, the MEMS shutter 121 either unblocks or redirects the laser 111 light enabling it to impact and ignite the RNT foil 141. In step 314, the ignited RNT foil 141 rapidly heats up to over 1000° C., igniting the primary explosive (or pyrotechnic) charge 142 (201 of FIG. 2). Or in an alternative design, the explosive charge unit 140 does not include RNT foil 141 and laser 111 directly ignites the primary explosive charge 142.

The ordnance fuse apparatus 100 is implemented as an integrated system that includes a specially built chip (110, 130) that includes laser 111, with an integrated detector 114, and a micromachined lens 130. Illustratively, this laser/detector/lens chip (110 and 130) may be implemented as an Indium Phosphide (InP) chip. The laser/detector/lens chip and MEMS unit 120 (including an optical shutter/switch and an accelerometer g-switch) may be bonded to a conventional "micro" core unit. An integrated thin film of energetic, nano-metal foil 141 is attached to the micro-core unit. The sensitivity of the RNT foil 141 is selected to safely and reliably operate in the hostile environment of the ordnance. The RNT foil (or pyrotechnic or explosive charge) 141 may be encapsulated in a glass for passivation and protection. The glass could be a spin-on or sol-gel like glass. The glass envelope protects the nano metal from heat or chemical attack. However, the glass is easily penetrated by a laser pulse; the heat of that laser pulse is contained within the "oven" like chamber created by the glass encapsulation and detonation can occur rapidly and reliably. Thus the glass coating both protects the foil from oxidation or contamination, and enhances its explosive performance. So the heat from a focused laser pulse (which readily penetrates the glass envelope, if present) starts a reaction in the RNT foil 141 that quickly heats up to over 1000° C., thus detonating the explosive charge 142 rapidly and reliably.

Note the RNT foil 141 produces heat but no shock wave when ignited. Many ordnance applications require a shock wave of expanding gas to initiate an explosive chain. In accordance with another feature, our ordnance fuse apparatus 100 may be implemented to layer the RNT foil 141 with a thin layer or coating 143 of an explosive compound, such as silver azide or lead azide, that will be ignited by the heat of the ignited RNT foil 141 and generate the shock wave needed to initiate an explosion in the primary explosive charge 142. The thin explosive layer 143 could be for example sputtered or painted onto the RNT foil 141. This approach combines the laser ignition of the RNT foil 141 with the shock wave generation utilized to initiate a conventional explosive.

Our ordnance fuse apparatus 100 incorporates a number of unique safety features including:

a) In one embodiment, the MEMS unit 120 contains a movable shutter, a shutter position sensor, and an accelerometer switch. Note in its simplest embodiment, the MEMS unit 121 contains only a movable shutter. This shutter is initially in the closed position, blocking any light from the laser from reaching the RNT foil 141. When controller 150 receives data and power, the laser 111 outputs a low-power signal, which is reflected or passed by the shutter 121 onto a detector 114. When operating in low-power mode, the laser 111 intensity is set at a level that is too weak to ignite the RNT foil 141: even if the shutter 121 were to accidentally be open, the RNT foil 141 could not ignite. Signals from detector 114 and from the shutter position sensor are used to confirm correct device operation (self-test). This information is sent back by controller 150 to the fire control box along with the decoded data.

b) When the ordnance is fired a MEMS accelerometer 122 is irreversibly moved by the rapid acceleration: only then is the MEMS shutter 121 free to move in response to a control signal from controller 150, which is applied after the predetermined programmed time has elapsed or a signal received from a shock sensor. The ordnance fuse apparatus 100 thus cannot ignite the RNT foil 141 or explosive charge 142 unless the MEMS shutter 121 has been exposed to a sufficient acceleration for a sufficient time: The ordnance fuse apparatus 100 cannot be detonated prior to being fired.

c) Once the MEMS shutter 121 is in its fully armed position, the laser 111 power is ramped up to its maximum value. The laser radiation ignites the RNT foil 141, which heats up to over 1000° C., igniting the explosive charge. By separating the RNT foil 141 and explosive charge 142 from the electrical signals of controller 150 (using laser 111 light as the source of energy for ignition), our ordnance fuse apparatus 100 is immune from detonating due to electrostatic discharge or electrical failure. The laser 111 acts like an opto-isolator, preventing accidental electrical ignition.

In a more simplified embodiment, our ordnance fuse apparatus 100 includes only a laser 111, a MEMS shutter 121, RNT foil 141, and controller 150. In this arrangement, safety features are reduced since controller 150 cannot determine whether laser 111 is operating at all or at what power level and cannot electrically determine that MEMS shutter 121 is in the correct position. Moreover, since no microlens 130 is used, laser 111 must have sufficient unfocused power to ignite the RNT foil 142.

Because of the "integrated circuit" type embodiment of our ordnance fuse apparatus 100, its very small size is approximately 1 to 4 cubic millimeter "monolithic cube." Such a monolithic cube would include all control, electronics, primer and a provision for wire termination, by ordinary means, to the power supply and trigger mechanism. Nano-engineered materials combined with micromachining techniques and advanced packaging technology enable this dramatic reduction in size, while increasing performance and reliability.

Various modifications of our invention will occur to those skilled in the art. Nevertheless all deviations from the specific teachings of this specification that basically rely upon the principles and their equivalents through which the art has been advanced are properly considered within the scope of the invention as described and claimed.

We claim:

1. A fuse apparatus for igniting an explosive charge of an ordnance, the fuse apparatus comprising:

a laser adapted to generate a laser optical signal for igniting the explosive charge;

an electrically controlled mechanical switch comprising a base, an actuator connected to the base, and an actively controlled movable element adapted to move relative to the base as a function of an electrical control signal applied to the actuator, wherein the mechanical switch is adapted to be configured in:

a first switch configuration in which at least one of position and orientation of the movable element is controlled by the actuator to directly prevent the laser optical signal from impinging on the explosive charge; and a second switch configuration in which at least one of the position and the orientation of the movable element is controlled by the actuator to directly enable the laser optical signal to impinge on the explosive charge; and a control unit adapted to generate and transmit the electrical control signal to the actuator to change the configuration of the mechanical switch from the first switch configuration to the second switch configuration.

2. The fuse apparatus of claim 1, wherein:

the movable element of the mechanical switch is a shutter adapted to (1) block the laser optical signal to prevent the laser optical signal from impinging on the explosive charge in the first switch configuration and (2) unblock the laser optical signal to enable the laser optical signal to impinge on the explosive charge in the second switch configuration; and the actuator is adapted to change the position of the shutter from the first switch configuration to the second configuration based on the electrical control signal from the control unit.

3. The fuse apparatus of claim 1, wherein:

the laser has a controllable optical power level; and the control unit is further adapted to control the optical power level of the laser to generate either a low-power laser optical signal or a high-power laser optical signal, wherein:

the low-power laser optical signal is insufficient to ignite the explosive charge; and the high-power laser optical signal is sufficient to ignite the explosive charge.

4. The fuse apparatus of claim 3, further comprising an optical detector positioned such that:

the optical detector receives at least a portion of the laser optical signal reflected from the movable element of the mechanical switch, if the mechanical switch is in the first switch configuration; and the detector receives substantially no reflected laser optical signal from the movable element of the mechanical switch, if the mechanical switch is in the second switch configuration, wherein the optical detector is adapted to generate a detector signal for the control unit indicative of receipt of reflected laser optical signal.

5. The fuse apparatus of claim 4, wherein the control unit is further adapted to control the laser to generate:

the low-power laser optical signal if the detector signal indicates receipt of the reflected laser optical signal; and the high-power laser optical signal if the detector signal indicates non-receipt of the reflected laser optical signal.

6. The fuse apparatus of claim 1, wherein the control unit is adapted to:

detect firing of the ordnance; and control the configuration of the mechanical switch to change from the first configuration to the second configuration after detecting the firing of the ordnance.

7. The fuse apparatus of claim 6, further comprising an accelerometer adapted to generate an acceleration signal for the control unit indicative of the firing of the ordnance.

8. The fuse apparatus of claim 6, further comprising a spin sensor adapted to generate a spin signal for the control unit indicative of the firing of the ordnance.

9. The fuse apparatus of claim 1, wherein the mechanical switch is a MEMS device.

10. The fuse apparatus of claim 9, wherein the laser and the MEMS device are implemented as part of a single integrated device.

11. The fuse apparatus of claim 10, wherein the single integrated device further comprises a lens adapted to focus the laser optical signal from the laser onto the explosive charge in the second switch configuration.

12. The fuse apparatus of claim 1, wherein:

the movable element of the mechanical switch is a shutter adapted to (1) block the laser optical signal to prevent the laser optical signal from impinging on the explosive charge in the first switch configuration and (2) unblock the laser optical signal to enable the laser optical signal to impinge on the explosive charge in the second switch configuration;

the actuator is adapted to change the position of the shutter from the first switch configuration to the second configuration based on the electrical control signal from the control unit;

the laser has a controllable optical power level;

the control unit is further adapted to control the optical power level of the laser to generate either a low-power laser optical signal or a high-power laser optical signal, wherein:

the low-power laser optical signal is insufficient to ignite the explosive charge; and the high-power laser optical signal is sufficient to ignite the explosive charge;

further comprising an optical detector positioned such that:

the optical detector receives at least a portion of the laser optical signal reflected from the movable element of the mechanical switch, if the mechanical switch is in the first switch configuration; and the detector receives substantially no reflected laser optical signal from the movable element of the mechanical switch, if the mechanical switch is in the second switch configuration, wherein the optical detector is adapted to generate a detector signal for the control unit indicative of receipt of reflected laser optical signal;

the control unit is further adapted to control the laser to generate:

the low-power laser optical signal if the detector signal indicates receipt of the reflected laser optical signal; and the high-power laser optical signal if the detector signal indicates non-receipt of the reflected laser optical signal, the control unit is adapted to:

detect firing of the ordnance; and control the configuration of the mechanical switch to change from the first configuration to the second configuration after detecting the firing of the ordnance;

further comprising at least one of (i) an accelerometer adapted to generate an acceleration signal for the control unit indicative of the firing of the ordnance and (ii) a spin sensor adapted to generate a spin signal for the control unit indicative of the firing of the ordnance;

the mechanical switch is a MEMS device;

the laser and the MEMS device are implemented as part of a single integrated device; and the single integrated device further comprises a lens adapted to focus the laser optical signal from the laser onto the explosive charge in the second switch configuration.

* * * * *